US008137220B2

(12) United States Patent
Minarovic

(10) Patent No.: US 8,137,220 B2
(45) Date of Patent: Mar. 20, 2012

(54) ELECTRONIC MARKER STAKES FOR SPORTS FIELDS

(76) Inventor: Joe T. Minarovic, Georgetown, TX (US)

( * ) Notice: Subject to any disclaimer, the term of this patent is extended or adjusted under 35 U.S.C. 154(b) by 0 days.

(21) Appl. No.: 12/908,884

(22) Filed: Oct. 21, 2010

(65) Prior Publication Data

US 2011/0034276 A1 Feb. 10, 2011

Related U.S. Application Data

(62) Division of application No. 12/049,152, filed on Mar. 14, 2008, now Pat. No. 7,901,306.

(51) Int. Cl.
*A63B 71/02* (2006.01)

(52) U.S. Cl. ..... 473/490

(58) Field of Classification Search ..... 473/490
See application file for complete search history.

(56) References Cited

U.S. PATENT DOCUMENTS

| | | | |
|---|---|---|---|
| 3,067,717 | A | 12/1962 | Imparato |
| 3,371,647 | A | 3/1968 | Shopbell |
| 4,119,908 | A | 10/1978 | Cosman et al. |
| 4,218,059 | A | 8/1980 | Eiden |
| 4,489,669 | A | 12/1984 | Carman |
| 4,866,388 | A | 9/1989 | Cosman et al. |
| 5,186,119 | A | 2/1993 | Hlavin |
| 5,430,379 | A | 7/1995 | Parkinson et al. |
| 5,868,630 | A | 2/1999 | Saksun, Jr. |
| 5,878,505 | A | 3/1999 | Scarpellini |
| 6,099,412 | A | 8/2000 | Weibye |
| 6,142,882 | A | 11/2000 | Anglea |
| 6,330,503 | B1 | 12/2001 | Sharp et al. |
| 6,419,599 | B1 | 7/2002 | Kite |
| 6,751,880 | B1 | 6/2004 | Amron et al. |
| 6,796,041 | B2 | 9/2004 | Amron et al. |
| 6,895,677 | B2 | 5/2005 | Dinicola |
| 6,954,072 | B1 | 10/2005 | Schlapp et al. |
| 7,081,820 | B2 | 7/2006 | Minarovic |
| 7,382,266 | B2 | 6/2008 | Minarovic |
| 7,692,594 | B2 | 4/2010 | Minarovic |
| 2005/0055142 | A1 | 3/2005 | McMurtry et al. |
| 2005/0200484 | A1 | 9/2005 | Minarovic |
| 2008/0254920 | A1 | 10/2008 | Oresky |
| 2009/0058421 | A1 | 3/2009 | Minarovic |
| 2009/0197710 | A1 | 8/2009 | Ronda |
| 2009/0233739 | A1 | 9/2009 | Minarovic |

*Primary Examiner* — Raleigh W. Chiu
(74) *Attorney, Agent, or Firm* — Jack V. Musgrove

(57) ABSTRACT

A marker stake for locating a boundary reference point on a sports field can be buried and out of sight when not in use, and then quickly located using an electronic receiver which detects a signal emitted by an electronic marker in the marker stake. Various field boundary indicators can be removably attached to the marker stake. The stake may be embodied in a cylindrical body constructed of a moldable polymer with a socket at one end for receiving a pin or post of the field boundary indicator, and the electronic marker embedded inside the body. The electronic marker may be a passive LC marker tuned to a frequency associated with a known field sport. Different sets of such marker stakes tuned to different frequencies may be used to mark and relocate reference points for multiple sports played on the same field.

6 Claims, 7 Drawing Sheets

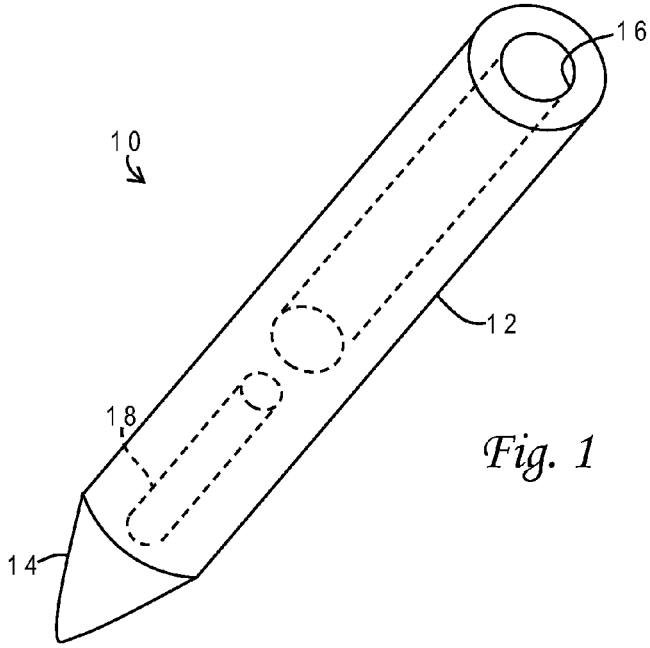
Fig. 1
Fig. 2
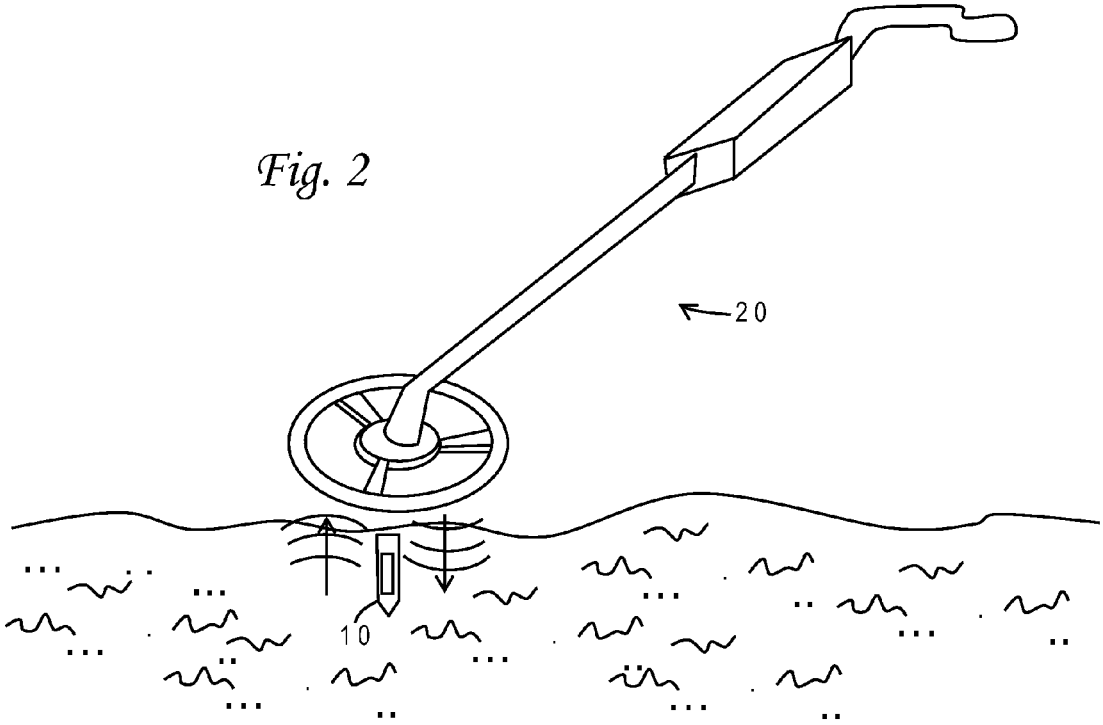

ELECTRONIC MARKER STAKES FOR SPORTS FIELDS

CROSS-REFERENCE TO RELATED APPLICATION

This application is a divisional of U.S. patent application Ser. No. 12/049,152 filed Mar. 14, 2008 now U.S. Pat. No. 7,901,306.

BACKGROUND OF THE INVENTION

1. Field of the Invention

The present invention generally relates to surveying, and more particularly to methods and devices for staking out boundaries or other features of a sports field such as field lines for a football field or soccer field.

2. Description of the Related Art

Sporting events that take place on a field or course with boundary lines or other demarcations must have accurate field measurements to ensure fair game play. Both players and spectators expect that the field lines for a competition will be perfect in geometry and dimensions. These requirements and expectations place a high burden on the field maintenance crew that must install boundary markers such as pegs or posts and paint markings on the field.

Current practice for sports field lining techniques requires considerable effort by field set up personnel to survey the field with measuring tapes, distance measuring wheels, theodolites or other equipment to locate various coordinates for each selected sport. Upright posts or flagged rods can be planted at these locations, or stakes can be inserted into the ground and a taut string tied between them to act as a guide for painting a stripe. Striping or other marks are then placed on the field indicating line positions or various surface point marking positions such as yard marking, hash marks, field centers, etc. The visual line marking points may be temporary or permanent, and can be used by line marking crews for visual referencing and by players and field judges for accurate refereeing.

Above-ground marking targets can present a hazard to players and so are often designed to be easily removed. One example of such a marking system is described in U.S. Pat. No. 5,186,119. Ground anchors are located at intersecting points of playing field lines, and the ground anchors are adapted to support various implements such as a peg having a spool of string, a numeric yard line marker, a flag pole, or a fence post. A soft marker pylon may also be supported by a flexible spring inserted into the ground anchor, so the pylon can bend under the impact of a player to avoid injury to the player or damage to the pylon, and thereafter spring back upright.

More complicated automated systems for sports field staking and marking are described in U.S. Pat. No. 6,330,503 and U.S. Patent Application No. 2005/0055142. The first of those inventions is directed to a vehicle running on autopilot which uses a global positioning system (GPS) receiver to locate the proper positions for driving stakes into the ground based on pre-programmed geographical coordinates. The second disclosure teaches an autonomous ground maintenance vehicle which applies field markings based on an X-Y coordinate system, and use of an infrared sensor to detect signals from reflective targets at known positions of the coordinate system and determine the location of the vehicle within the X-Y coordinate system.

One problem in the maintenance of field lines is that posts or stakes can be removed by play, weather or vandals, and the field must often be re-surveyed to re-locate the boundary reference points. This problem is reduced by the use of anchors which remain buried underground, but when there is no above-ground visual indicator affixed to the anchor it can become difficult to locate at a later time due to turf growth or soil movement. These problems are exacerbated for fields which are used for more than one sporting event, e.g., an outdoor stadium employed at different times for football and soccer. The posts marking different boundary reference points must be repeatedly removed and replaced, sometimes on a daily basis. Surveying equipment must be allocated to such fields permanently, and highly-trained field maintenance personnel must always be on hand, at least during the sporting season. Problems in relocating boundary markers for a second or third sport may cause a significant delay in the start of a game. Even if the reference points or ground anchors are all locatable, there may still be confusion about which points are to be used for the particular sport. It would, therefore, be desirable to devise an improved method and system for marking sports fields which could simplify the locating of boundary reference points, particularly for fields which are used with multiple sports. It would be further advantageous if relocation of the boundary points did not require complicated equipment or rigorous training of field personnel.

SUMMARY OF THE INVENTION

It is therefore one object of the present invention to provide an improved method for marking geographical reference points such as boundary lines or intersections for an athletic field sport.

It is another object of the present invention to provide such a method which simplifies relocation of a geographical reference point even if there is no above-ground visual indicator.

It is yet another object of the present invention to provide such a method which can be used to easily locate different sets of boundary reference points for different field sports.

The foregoing objects are achieved in an electronic marker stake system for locating reference points in a field to be used for multiple sports, generally comprising a first set of marker stakes adapted to be placed in the ground and removably receive first field boundary indicators, wherein the first set of marker stakes emit a first signal associated with a first field sport (e.g., football), and a second set of marker stakes adapted to be placed in the ground and removably receive second field boundary indicators, wherein the second set of marker stakes emit a second signal associated with a second field sport (e.g., soccer). The electronic marker stake system preferably utilizes a single electronic locator (receiver or transceiver) which selectively detects either of the first signal and the second signal. The stakes may use passive electronic markers tuned to predetermined frequencies, or smart markers having individually assigned identification numbers which indicate a sequence that defines a field boundary.

The above as well as additional objectives, features, and advantages of the present invention will become apparent in the following detailed written description.

BRIEF DESCRIPTION OF THE DRAWINGS

The present invention may be better understood, and its numerous objects, features, and advantages made apparent to those skilled in the art by referencing the accompanying drawings.

FIG. 1 is an isometric view of an electronic marker stake constructed in accordance with one embodiment of the present invention, having an internal electronic marker and a socket for receiving a flag pin;

FIG. 2 is a perspective view illustrating use of an electronic transceiver to locate a buried electronic marker stake in accordance with the present invention;

The use of the same reference symbols in different drawings indicates similar or identical items.

DESCRIPTION OF THE PREFERRED EMBODIMENT(S)

Figure 4:
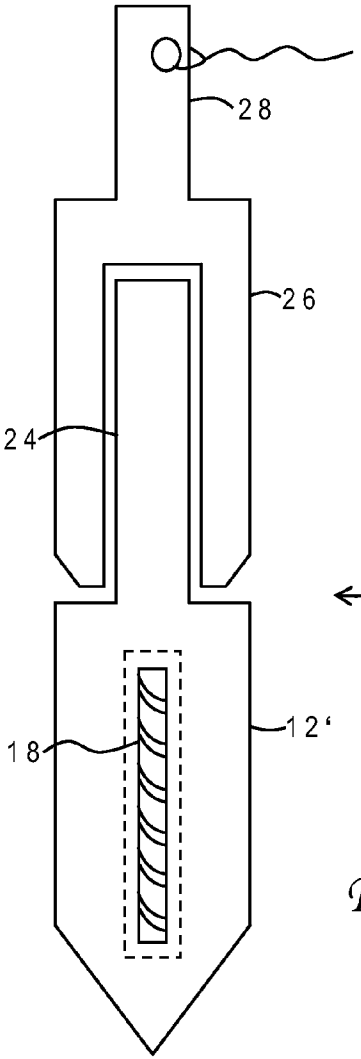
FIG. 4 is a side view of an electronic marker stake constructed in accordance with another embodiment of the present invention, having a peg which receives the receptacle of a post used to secure one end of a guide string.

With reference now to the figures, and in particular with reference to FIG. 1, there is depicted one embodiment 10 of an electronic marker stake constructed in accordance with the present invention, for use in marking boundaries or other features of a sports field. Electronic marker stake 10 is comprised of a generally cylindrical body 12 having one end 14 adapted for planting in the ground, e.g., a conical or frusto-conical shaped tip. Body 12 has a cavity or socket 16 at the other end for removably receiving various implements such as a flag pole, pylon peg, guide post, etc. An electronic transponder or marker 18 is embedded inside body 12, preferably below cavity 16.

Body 12 may be constructed of any durable material, preferably a moldable polymer such as polyethylene or polypropylene. Electronic marker 18 may be embedded in body 12 by insert molding, or by drilling a hole in either end of body 12 and press-fitting the marker into the hole. The dimensions of body 12 may vary considerably depending upon the application and desired performance requirements. In an exemplary embodiment body 12 is 8" long, 1" in outer diameter, and socket 16 has an inner diameter of ½".

Electronic marker 18 may be based on a variety of electronic marker designs, e.g., active markers, passive markers, smart markers (radio-frequency identification), etc. In the illustrative embodiment electronic marker 18 is a passive resonant marker constructed by winding a wire coil about a ferrite core and connecting the ends of the wire to pins of a capacitor forming a resonant (LC) circuit. The axis of the ferrite core marker (i.e., the axis of the wire coil and ferrite cylinder) is generally parallel with the axis of body 12. The passive marker may be tuned to a specified (predetermined) frequency using known techniques and, as illustrated in FIG. 2, the electronic marker stakes may be located after burial using a conventional transceiver locator 20 which sends an electromagnetic signal into the ground at the resonant frequency to energize the passive marker during an activation phase and then receives the echo signal from the passive marker during a listening phase.

In particular, a system of electronic marker stakes may be provided using a first set of stakes having passive markers tuned to a first frequency (e.g., 101.4 kHz) and a second set of stakes having passive markers tuned to a second frequency (e.g., 83 kHz), wherein different stake sets are used to lay out boundary reference points for two different sports played on the same field, i.e., the first set of stakes marks a first set of boundary reference points and the second set of stakes marks a second set of boundary reference points. Transceiver locator 20 may be an adjustable transceiver which can locate the marker stakes by selecting the frequency of the transceiver to match the frequency of the set of stakes that are desired to be located. Those skilled in the art will appreciate that a tunable resonant frequency is only one of many possible techniques for differentiating the electromagnetic signals emanating from different sets of the electronic marker stakes. In an alternative embodiment the markers are smart markers, that is, radio-frequency encoded identification markers which may be assigned a given identification number, so the first set of marker stakes are assigned a first ID number and the second set of marker stakes are assigned a second ID number, and the transceiver can selectively detect markers having the appropriate ID number. There may be more than two sets of markers, i.e., multiple resonant frequencies or ID numbers, if more than two different sports are played on the same field. A single stake may also contain more than one electronic marker, e.g., two markers (axes aligned) having two different resonant frequencies to mark a spot that is used as a boundary reference point for both football and soccer.

Figure 3:
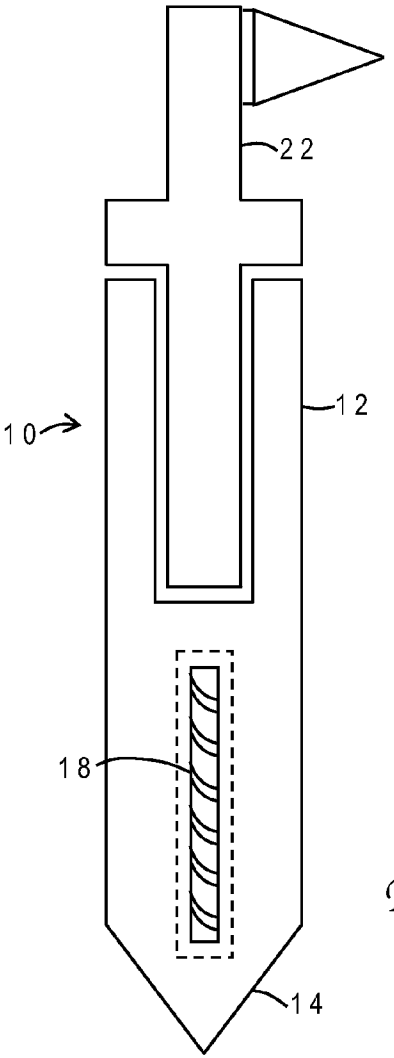
FIG. 3 is a side view of the electronic marker stake of FIG. 1 showing a flag pin inserted into the socket.

As noted above socket 16 of electronic marker stake 10 may receive and support various implements. FIG. 3 illustrates a side view in which electronic marker stake 10 is supporting a flag pin 22. The support feature of electronic marker stake 10 is female, that is, a socket, but in the male design of FIG. 4 the support feature of alternative electronic marker stake 10' is a peg 24. Peg 24 fits inside a receptacle formed in the lower end of a post 26. The upper end of post 26 has a hole therein for tying down one end of a guide string 28 that may be used for paint or chalk striping. For either of these implementations, the electronic marker stake is substantially buried, and the top of the stake is even with ground level. The desired implement can then be attached to the support end of the electronic marker stake, extending above-ground. The implement may be flexible or attached using a hinge or spring mechanism which allows the implement to yield under the impact of a player or other object.

Further embodiments **10*a*-10*f* of anchored electronic marker stakes are illustrated in FIGS. 5-10. The body of anchored electronic marker stake 10***a* of FIG. 5 has an anchor-shaped tip 30 to help secure the device in the ground and resist removal. The tubular wall forming the socket of electronic marker stake 10*a* has a series of holes which receive and support the ends of ribs 32 formed along the outside of a post 34. Post 34 similarly has a hole therein for tying down one end of a guide string.

Figure 6:
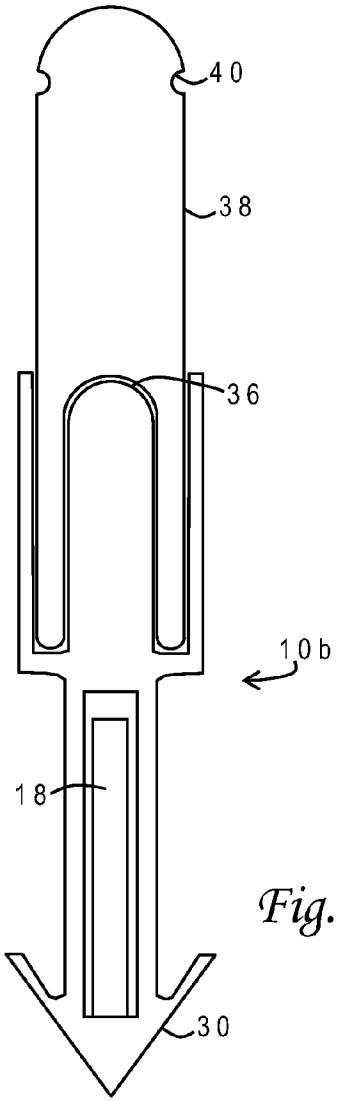
FIG. 6 is a side view of an anchored electronic marker stake constructed in accordance with another embodiment of the present invention, having a socket with an internal upright support which receives a post having an annular groove for receiving one end of a guide string.
Figure 5:
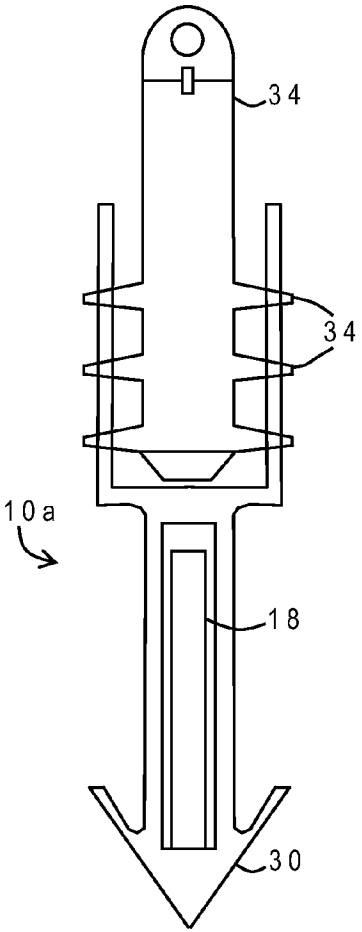
FIG. 5 is a side view of an anchored electronic marker stake constructed in accordance with another embodiment of the present invention, having a socket with ribbed peg insert.

The socket of anchored electronic marker stake 10*b* of FIG. 6 has a central protuberance or peg 36 for hybrid male/female attachment and support of a post 38. Post 38 has an annular groove at the top end for winding a length of guide string.

Figure 7:
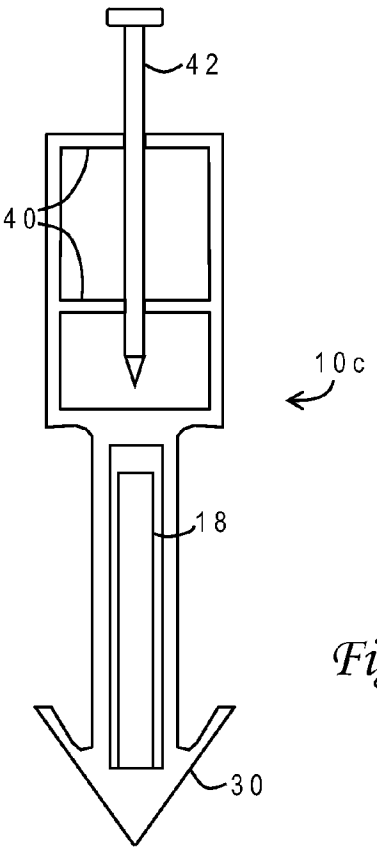
FIG. 7 is a side view of an anchored electronic marker stake constructed in accordance with another embodiment of the present invention, having inner annular flanges defining holes to support a nail.

The socket of anchored electronic marker stake 10*c* of FIG. 7 has two inwardly-extending annular flanges 40 defining holes which tightly grip a nail or spike 42. Spike 42 can similarly be used to retain one end of a taut guide string.

Figure 8:
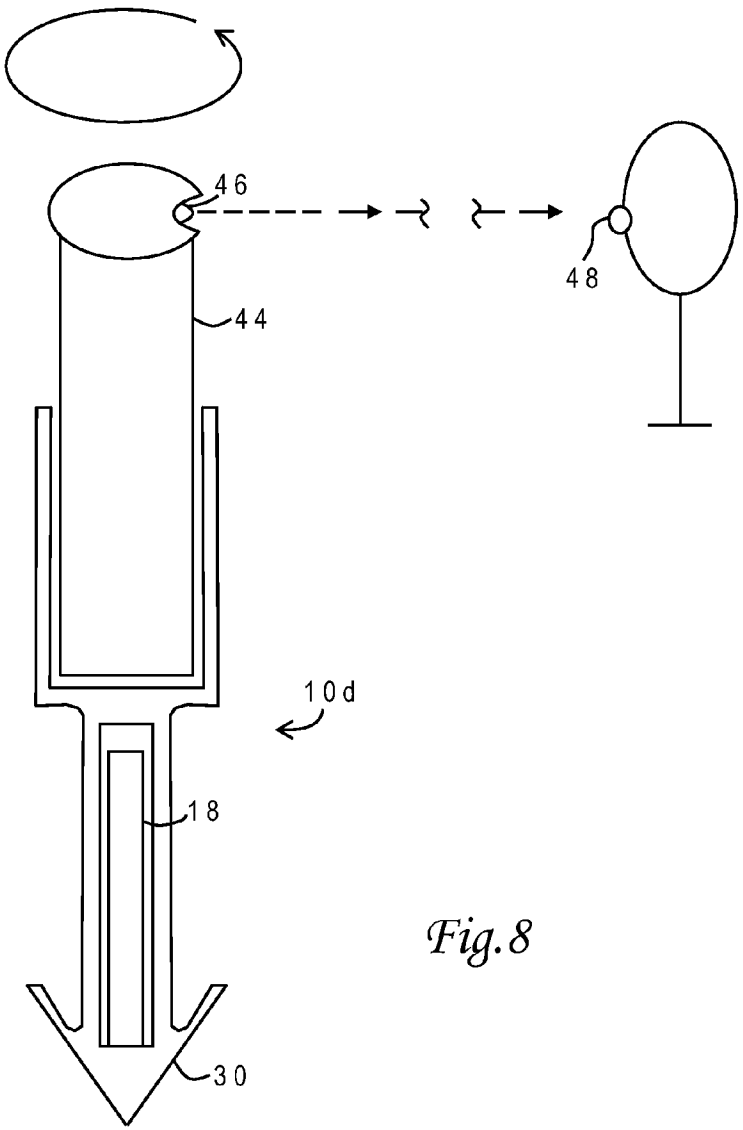
FIG. 8 is a side view of an anchored electronic marker stake constructed in accordance with another embodiment of the present invention, having a light signal source such as a laser which may be rotated to aim at a photoelectric eye.

The anchored electronic marker stake 10*d* of FIG. 8 has a larger socket which rotatably supports a cylindrical post 44. Post 44 has an external switch connected to an internal battery that powers a laser or laser diode 46. Post 44 may be rotated at different orientations to aim the beam from laser 46 to a photoelectric eye 48 or other target at a remote location of the field for surveying purposes, e.g., triangulation or navigation, or to serve as a guide for striping or other marking.

Figure 9:
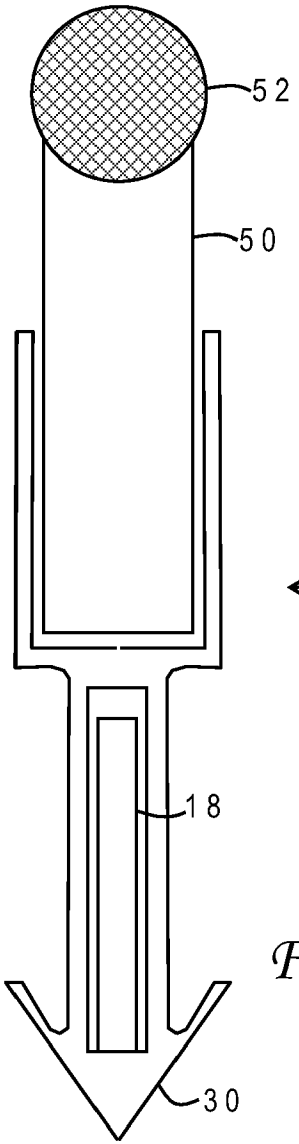
FIG. 9 is a side view of an anchored electronic marker stake constructed in accordance with another embodiment of the present invention, having a retroreflective marker.

The anchored electronic marker stake 10*e* of FIG. 9 is essentially identical to stake 10*d* of FIG. 8 and is shown supporting a different post 50 which has at its top end a retroreflective disk 52. Retroreflective disk 52 serves as a target for another light source, e.g., laser beam at a remote location which a sensor which detects the reflected light signal from disk 52.

Figure 10:
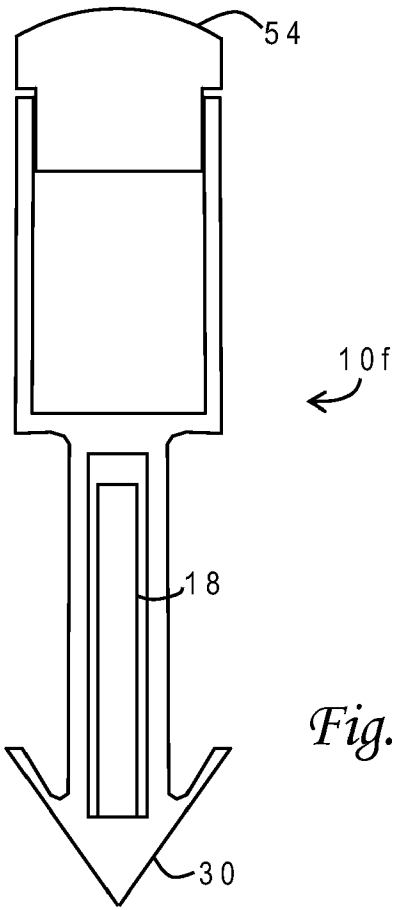
FIG. 10 is a side view of an anchored electronic marker stake constructed in accordance with another embodiment of the present invention, having a cap to prevent soil from filling the socket.

The anchored electronic marker stake 10*f* of FIG. 10 is essentially identical to stake 10*d* of FIG. 8 and is shown with a cap 54. The lower portion of cap 54 has an outer diameter which is approximately the same as the inner diameter of the stake socket for a friction fit. The upper portion of cap 54 has a slightly larger outer diameter to overlap the top edges of stake 10*f*. The upper surface of cap 54 may be painted with a bright color to facilitate visual locating of the stake or for use as a turf-level boundary point marker.

Drain holes may be added to the bodies in any of these designs to keep water from building up within a body socket.

Figure 11:
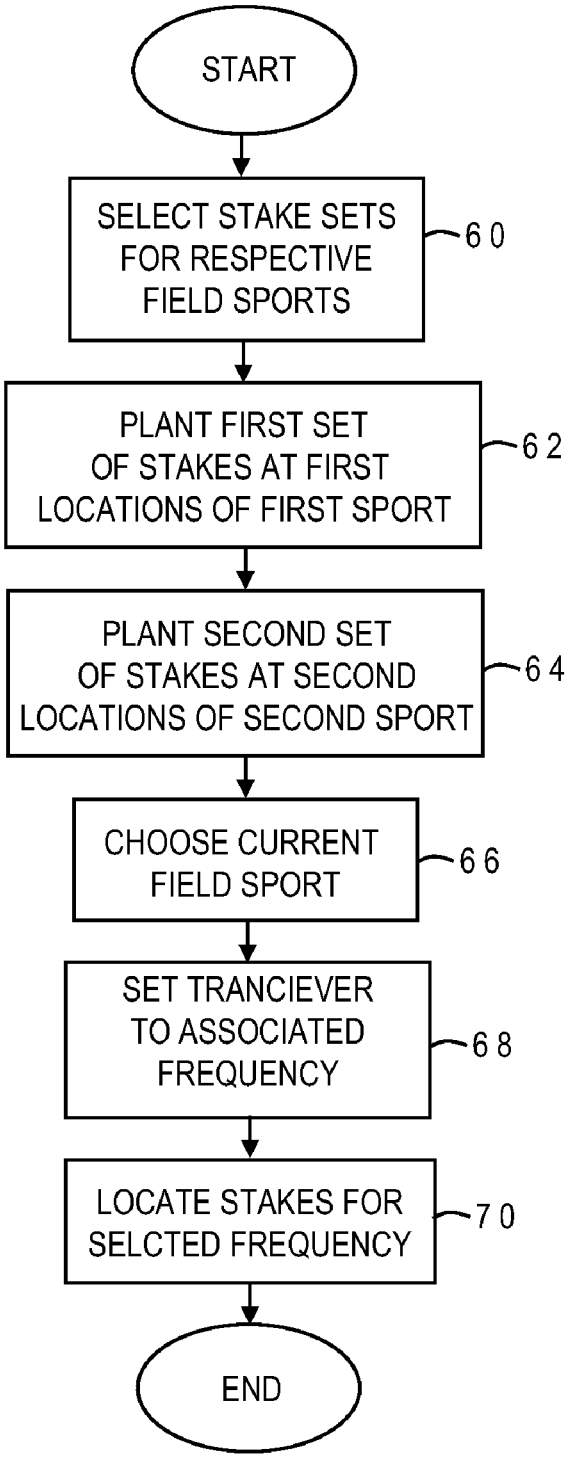
FIG. 11 is a flow chart for a method of laying out and using a system of electronic marker stakes in accordance with the present invention wherein the system uses at least two sets of electronic marker stakes having different electronic signals to mark boundary features of two different field sports.

The present invention may be further understood with reference to the flow chart of FIG. 11 illustrating one implementation for a sports field which is to be used for two different sports. The method begins by selecting stakes sets for the respective field sports (60). For example, a first set of stakes having a first resonant frequency may be associated with football, and a second set of stakes having a second resonant frequency may be associated with soccer. Field personnel then plant the first set of stakes at first locations according to the particular dimensions and boundaries for this type of football using conventional surveying techniques (62), and plant the second set of stakes at second locations according to the particular dimensions and boundaries for this type of soccer (64). The personnel can drive the stakes into the ground with a hammer or rubber mallet, or can use a boring tool to make holes that are slightly smaller than the stake body. The tops of the stakes are preferably flush with the ground level once installed. Thereafter when the field is to be used for a given sport (66), the field personnel need only one transceiver whose detection frequency is set to the associated frequency for the chosen sport (68). The stakes having this frequency are then located (70) and appropriate implements are attached to each stake as desired.

Figure 12:
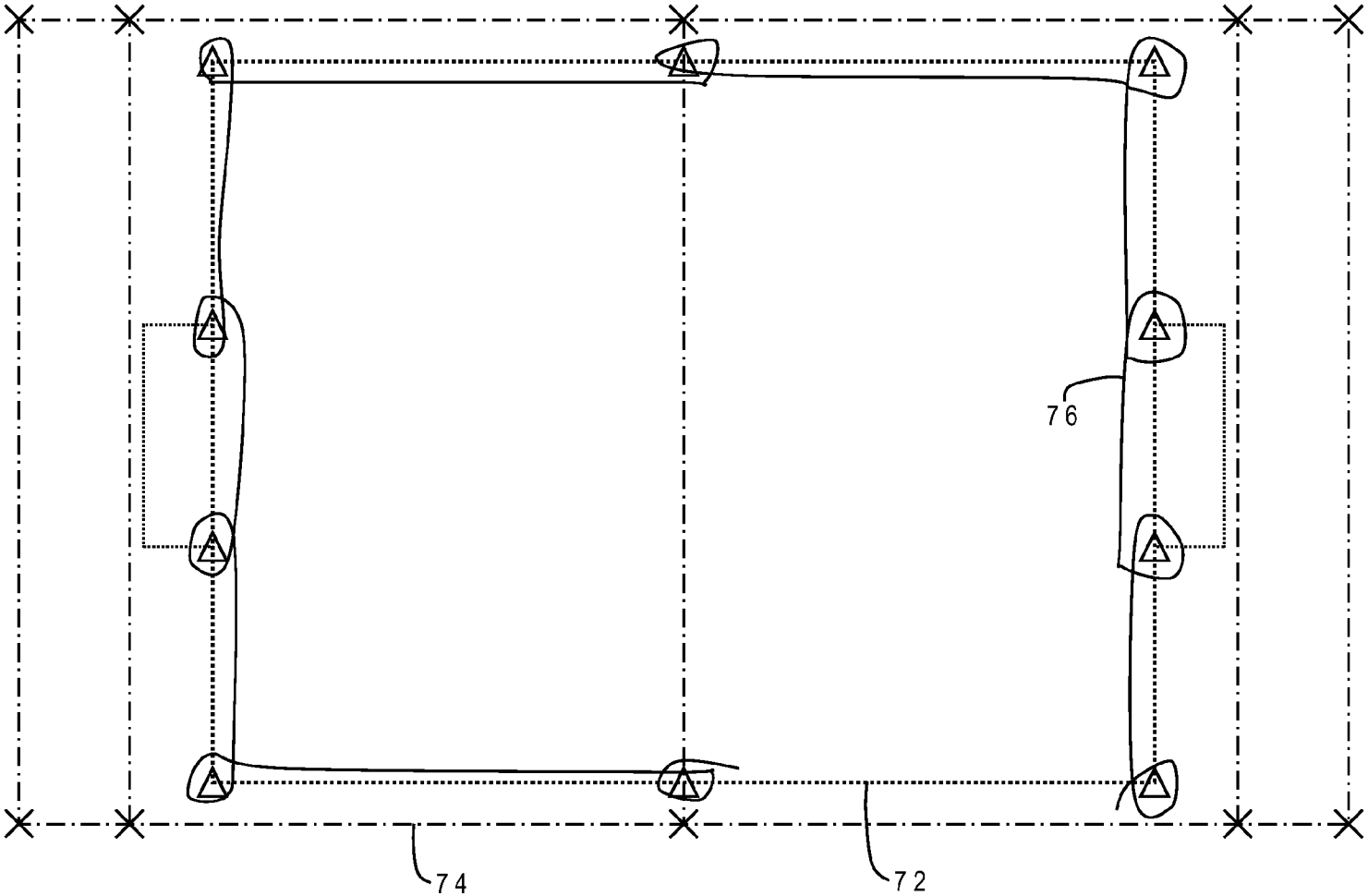
FIG. 12 is a plan view of a sports field showing one set of electronic marker stakes (X's) defining boundaries for a first field sport, and another set of electronic marker stakes (triangles) defining boundaries for a second field sport, in accordance with the present invention.

FIG. 12 is a plan view showing how a sports field may be marked in accordance with the implementation of FIG. 11. In this example various boundary lines are indicated for a soccer field by dotted lines 72 and for a football field by dot-dash lines 74. The first set of electronic marker stakes located at reference or intersection points of the football boundaries are designated with X's, and the second set of electronic marker stakes located at reference or intersection points of the soccer boundaries are designated with triangles. When the field is being used for football various above-ground boundary indicators are attached to the first set of stakes; the second set of stakes are capped, and may be hidden by the turf Similarly when the field is being used for soccer various above-ground boundary indicators are attached to the second set of stakes and the first set of stakes are not used. The invention thus provides invisible sports field stencils for the layout of different sports. Repeated use of a field for different sports is greatly simplified and field set-up times are significantly reduced since the reference locations need to be measured and marked only once, and thereafter are easily relocated using the adjusted transceiver and used to refresh boundary lines, while still assuring consistent field dimensional accuracy.

The particular dimensions and shapes of boundaries may be changed to suit the circumstances of the field, sport or players. Reference locations may be marked not only for proper boundaries (perimeters) and internal lines or points, but also features external to a boundary such as the coach's area, the team bench area, sidelines, etc. A boundary reference point might be used to draw curves as well as straight lines, such as the center of a circle or a focus of an ellipse, parabola, etc. Field sports that may benefit from the system of the present invention include without limitation football (high school, US professional, Canadian, European), baseball, soccer, rugby, lacrosse, volleyball, tennis, badminton, pickleball, field hockey, and golf driving ranges, tee boxes, greens and traps.

Stakes may optionally be color-coded for each sport application, e.g., red for football, green for soccer, etc., to provide additional point selection confirmation by field set-up personnel. Other mechanisms may also be employed to ensure use of proper above-grade implements with the corresponding stakes, such as keying (polarization) of removable pegs with sockets in the stakes.

FIG. 12 also illustrates the use of a buried line 76 to energize the passive markers. Line 76 extends serially from one stake in the second set (triangles) to another and may be buried just below the ground surface. Portions of line 76 are manually wound around each electronic marker stake in this set such that the windings have a generally vertical axis, i.e., parallel with the vertical axes of the wire coils in each of the passive markers. In this manner, when a voltage signal is sent through line 76 at a frequency corresponding to the resonant frequency for these stakes, the passive markers will be energized and emit the locating signals. The voltage signal may be applied at a connectorized end 78 of line 76 that is above-grade or buried just underground in a small weatherproof box. Line 76 may be a single wire, or two wires that are shorted together at the distal end. For this implementation only an adjustable receiver locator is necessary, i.e., not a transceiver locator. A transceiver locator is also not necessary if the stakes have active markers, i.e., self-powered by internal batteries.

Electronic marker stakes deployed in accordance with the present invention may also be used in a connect-the-dots procedure to define a path for a field line or stripe between successive stakes without the need for any measurements. One stake may be designated as a starting point, with predetermined instructions on which compass directions to move until each next stake is located, based on the field boundary details. Alternatively any visible physical object (such as a permanently installed football goal post) may be used as the reference (beginning) point. In a further variation of such a system the stakes have smart markers with individually assigned RF ID tags that reflect their order in a layout sequence, e.g., marker ID tags A1, A2, A3, etc. for one set of the stakes (football), and marker ID tags B1, B2, B3, etc. for another set of stakes (soccer). These procedures may be used manually or implemented within automated equipment (i.e., a paint striping vehicle).

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. It is therefore contemplated that such modifications can be made without departing from the spirit or scope of the present invention as defined in the appended claims.

What is claimed is:

1. A method of laying out a boundary of a sports field, comprising:

placing a first set of marker stakes in a field at first locations corresponding to reference points for a first field sport, wherein the first plurality of marker stakes emit a first signal;

placing a second set of marker stakes in the field at second locations corresponding to reference points for a second field sport, wherein the second plurality of marker stakes emit a second signal; and locating the first set of marker stakes using a locator which detects the first signal.

2. The method of claim 1 wherein the first signal has a first frequency and the second signal has a second frequency which is different from the first frequency.

3. The method of claim 1 wherein the marker stakes have passive electronic markers and the locator is a transceiver which energizes the passive electronic markers during an activation phase and receives an echo signal from the passive markers during a listening phase.

4. The method of claim 1, further comprising:

adjusting the locator to detect the second signal; and locating the second set of marker stakes using the locator.

5. The method of claim 1, further comprising:

defining a path for a field stripe by moving from a starting one of the marker stakes to a next one of the marker stakes according to a predetermined direction for the path.

6. The method of claim 5 wherein the starting and next marker stakes have individually assigned identification numbers which indicate a sequence that defines a field boundary.

* * * * *